US011373603B2

(12) United States Patent
Lee et al.

(10) Patent No.: US 11,373,603 B2
(45) Date of Patent: Jun. 28, 2022

(54) LIGHT EMITTING DISPLAY APPARATUS AND DRIVING METHOD THEREOF

(71) Applicant: LG Display Co., Ltd., Seoul (KR)

(72) Inventors: Sang Uk Lee, Seoul (KR); Soon Dong Cho, Gumi-si (KR); Jung Jae Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/357,712

(22) Filed: Jun. 24, 2021

(65) Prior Publication Data

US 2022/0036828 A1 Feb. 3, 2022

(30) Foreign Application Priority Data

Jul. 30, 2020 (KR) ..... 10-2020-0095275

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2310/08* (2013.01); *G09G 2320/045* (2013.01); *G09G 2330/02* (2013.01); *G09G 2330/12* (2013.01)

(58) Field of Classification Search
None
See application file for complete search history.

(56) References Cited

U.S. PATENT DOCUMENTS

2017/0039953 A1* 2/2017 Lee ..... G09G 3/3233

FOREIGN PATENT DOCUMENTS

| | | | |
|---|---|---|---|
| KR | 10-2015-0078846 | A | 7/2015 |
| KR | 10-2017-0003795 | A | 1/2017 |
| KR | 10-2020-0037678 | A | 4/2020 |
| KR | 10-2096092 | B1 | 4/2020 |

* cited by examiner

*Primary Examiner* — Christopher J Kohlman
(74) *Attorney, Agent, or Firm* — Fenwick & West LLP

(57) ABSTRACT

The present disclosure provides a light emitting display apparatus including a display panel displaying an image, a power supply supplying a driving voltage to the display panel, a data driver supplying a data voltage to the display panel, a timing controller controlling the power supply and the data driver, and a sensing circuit unit receiving a feedback component of the driving voltage as a feedback voltage and selectively sensing an electrically stabilized period in the feedback voltage based on an internal control signal of the power supply.

12 Claims, 15 Drawing Sheets

LIGHT EMITTING DISPLAY APPARATUS AND DRIVING METHOD THEREOF

CROSS-REFERENCE TO RELATED APPLICATIONS

This application claims the benefit of Korean Patent Application No. 10-2020-0095275, filed on Jul. 30, 2020, which is hereby incorporated by reference as if fully set forth herein.

BACKGROUND

Field of the Technology

The present disclosure relates to a light emitting display apparatus and a driving method thereof.

Discussion of the Related Art

As information technology advances, the market for display apparatuses which are connection mediums connecting a user to information is growing. Therefore, the use of display apparatuses such as light emitting display apparatuses, quantum dot display (QDD) apparatuses, and liquid crystal display (LCD) apparatuses is increasing.

The display apparatuses described above include a display panel which includes a plurality of subpixels, a driver which outputs a driving signal for driving the display panel, and a power supply which supplies power to the display panel or the driver.

In such display apparatuses, when the driving signal (for example, a scan signal and a data signal) is supplied to each of the subpixels provided in the display panel, a selected subpixel may transmit light or may self-emit light, and thus, an image may be displayed.

In the display apparatuses described above, the light emitting display apparatuses have electrical and optical characteristics, have a fast response time, high luminance, and a wide viewing angle, and a mechanical characteristic which is capable of being implemented in a flexible form. However, there is a limitation in applying the light emitting display apparatuses to various applications, and thus, continuous research for overcoming the limitation is needed.

SUMMARY

To overcome the aforementioned problem of the related art, the present disclosure may provide a light emitting display apparatus and a driving method thereof, in which a degradation in an organic light emitting diode included in a display panel is accurately sensed and compensated for, and a configuration of a compensation device is simplified.

To achieve these objects and other advantages and in accordance with the purpose of the disclosure, as embodied and broadly described herein, a light emitting display apparatus includes a display panel displaying an image, a power supply supplying a driving voltage to the display panel, a data driver supplying a data voltage to the display panel, a timing controller controlling the power supply and the data driver, and a sensing circuit unit receiving a feedback component of the driving voltage as a feedback voltage and selectively sensing an electrically stabilized period in the feedback voltage based on an internal control signal of the power supply.

The sensing circuit unit may detect a rising time of the control signal so as to exclude an electrically unstable period from a sensing period and may sense the feedback voltage after a certain delay time elapses from the rising time of the control signal.

The sensing circuit may sense the feedback voltage with respect to a certain period, a certain time, and a certain count, on the basis of the control signal.

Based on a voltage follower where an input impedance thereof is large, the sensing circuit unit may sense an analog feedback voltage N (where N is an integer of 1 or more) times, convert the analog feedback voltage into a digital sensing value, average N number of sensing values to calculate an averaged sensing value, and provide the averaged sensing value to the timing controller.

When the averaged sensing value is greater than a reference value defined therein, the timing controller may perform a compensation operation of compensating for an organic light emitting diode included in the display panel, and when the averaged sensing value is less than the reference value defined therein, the timing controller may not compensate for the organic light emitting diode.

The sensing circuit unit may receive, as a feedback voltage, a feedback component of the driving voltage through a connection part provided between the power supply and a passive element unit cooperating with the power supply.

The sensing circuit unit may include a first sensing circuit unit including a voltage follower for receiving a feedback component of the driving voltage as a feedback voltage.

The sensing circuit unit may include a rising trigger detecting a rising time of the control signal, a delay delaying a certain time from the rising time of the control signal, a timer outputting an enable signal Enable or a disable signal on the basis of a signal transferred from the delay, and a second sensing circuit unit including an analog-to-digital converter (ADC) sensing the feedback voltage transferred from the first sensing circuit unit on the basis of the enable signal or the disable signal output from the timer.

The second sensing circuit unit may include a mean filter averaging a plurality of sensing values output through the ADC to calculate an averaged sensing value and a memory storing the averaged sensing value output from the mean filter.

In another aspect of the present disclosure, a driving method of a light emitting display apparatus includes driving a power supply to output a driving voltage for driving a display panel, receiving a feedback component of the driving voltage as a feedback voltage and detecting a rising time of a control signal of the power supply, and sensing the feedback voltage after a certain delay time elapses from a rising time of the control signal, for selectively sensing an electrically stabilized period in the feedback voltage.

The sensing may include sensing the feedback voltage with respect to a certain period, a certain time, and a certain count, on the basis of the control signal.

The driving method may further include converting the analog feedback voltage into a digital sensing value and averaging a plurality of sensing values to calculate an averaged sensing value, performing a compensation operation of compensating for an organic light emitting diode included in the display panel when the averaged sensing value is greater than a reference value defined therein, and stopping compensation performed on the organic light emitting diode when the averaged sensing value is less than the reference value defined therein.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE DISCLOSURE

Hereinafter, the present disclosure will be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art.

A light emitting display apparatus according to the present disclosure may be applied to televisions (TVs), video players, personal computers (PCs), home theaters, electronic devices for vehicles, and smartphones, but is not limited thereto. The light emitting display apparatus according to the present disclosure may be implemented with an inorganic light emitting diode or an organic light emitting diode. Hereinafter, however, for convenience of description, an organic light emitting display apparatus implemented based on an organic light emitting diode will be described for example.

Figure 1:
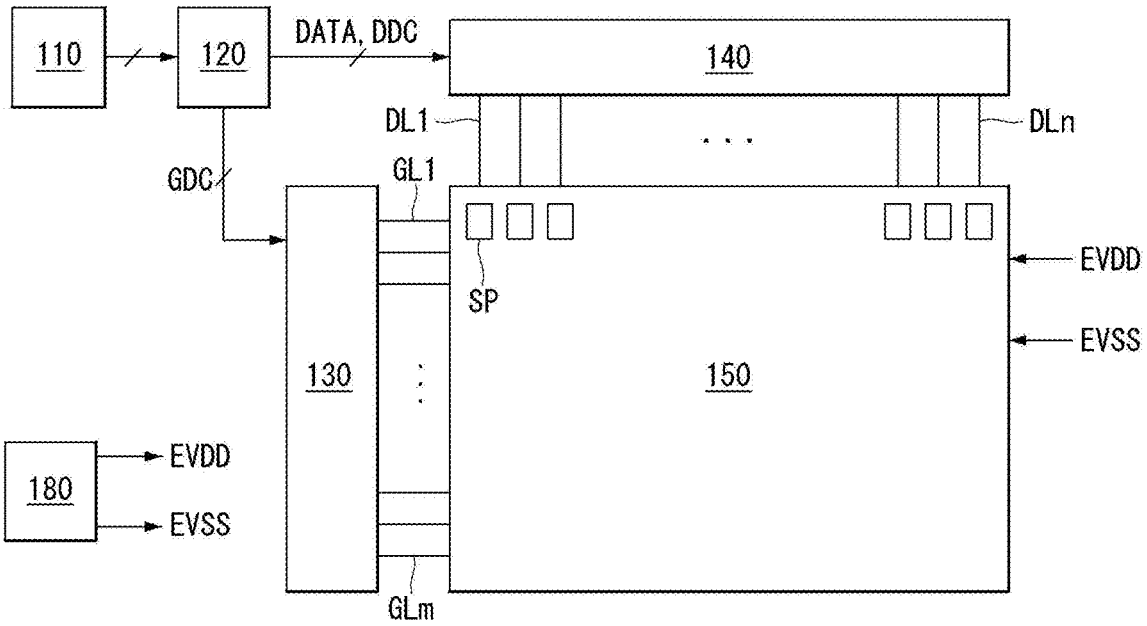
FIG. 1 is a block diagram schematically illustrating a light emitting display apparatus.
Figure 2:
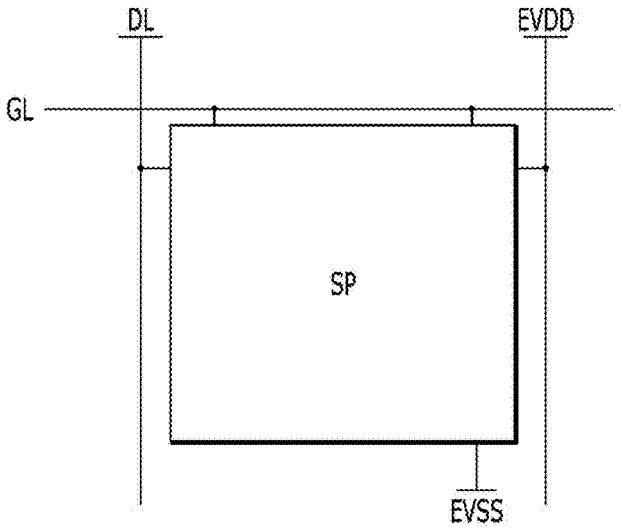
FIG. 2 is a configuration diagram schematically illustrating a subpixel illustrated in FIG. 1.

FIG. 1 is a block diagram schematically illustrating a light emitting display apparatus, and FIG. 2 is a configuration diagram schematically illustrating a subpixel illustrated in FIG. 1.

As illustrated in FIGS. 1 and 2, the light emitting display apparatus according to an embodiment of the present disclosure may include a video supply unit 110, a timing controller 120, a scan driver 130, a data driver 140, a display panel 150, and a power supply 180.

The video supply unit 110 (or a host system) may output a video data signal supplied from the outside or a video data signal and various driving signals stored in an internal memory thereof. The video supply unit 110 may supply a data signal and the various driving signals to the timing controller 120.

The timing controller 120 may output a gate timing control signal GDC for controlling an operation timing of the scan driver 130, a data timing control signal DDC for controlling an operation timing of the data driver 140, and various synchronization signals (for example, a vertical synchronization signal Vsync and a horizontal synchronization signal Hsync). The timing controller 120 may provide the data driver 140 with the data timing control signal DDC and a data signal DATA supplied from the video supply unit 110. The timing controller 120 may be implemented as an integrated circuit (IC) type and may be mounted on a printed circuit board (PCB), but is not limited thereto.

The scan driver 130 may output a scan signal (or a scan voltage) in response to the gate timing control signal GDC supplied from the timing controller 120. The scan driver 130 may supply the scan signal to a plurality of subpixels, included in the display panel 150, through a plurality of scan lines GL1 to GLm. The scan driver 130 may be implemented as an IC type or may be directly provided on the display panel 150 in a gate-in panel (GIP) type, but is not limited thereto.

In response to the data timing control signal DDC supplied from the timing controller 120, the data driver 140 may sample and latch the data signal DATA, convert a digital data signal into an analog data voltage on the basis of a gamma reference voltage, and output the analog data voltage. The data driver 140 may respectively supply data voltages to the subpixels of the display panel 150 through a plurality of data lines DL1 to DLn. The data driver 140 may be implemented as an IC type or may be mounted on the display panel 150 or a PCB, but is not limited thereto.

The power supply 180 may generate and output a first driving power EVDD having a high level and a second driving power EVSS having a low level on the basis of an external input voltage supplied from the outside. The power supply unit 180 may generate and output a voltage (for example, a scan high voltage and a scan low voltage) needed for driving of the scan driver 130 or a voltage (for example, a drain voltage and a half drain voltage) needed for driving of the data driver 140, in addition to the first driving power EVDD and the second driving power EVSS.

The display panel 150 may display an image on the basis of the scan signal, a driving signal including a data voltage, the first driving power EVDD, and the second driving power EVSS. The subpixels of the display panel 150 may each self-emit light. The display panel 150 may be manufactured on a substrate, having stiffness or flexibility, such as glass, silicon, or polyimide. Also, the subpixels emitting light may include pixels including red, green, and blue, or may include pixels including red, green, blue, and white.

For example, one subpixel SP may include a pixel circuit which includes a switching transistor, a driving transistor, a storage capacitor, and an organic light emitting diode. The subpixel SP applied to the light emitting display apparatus may self-emit light, and thus, may be complicated in circuit configuration. Also, the subpixel SP may further include various circuits such as a compensation circuit which compensates for a degradation in the organic light emitting diode emitting light and a degradation in the driving transistor supplying a driving current to the organic light emitting diode. Accordingly, it may be assumed that the subpixel SP is simply illustrated in a block form.

Hereinabove, each of the timing controller 120, the scan driver 130, and the data driver 140 has been described as an individual element. However, based on an implementation type of the light emitting display apparatus, one or more of the timing controller 120, the scan driver 130, and the data driver 140 may be integrated into one IC.

Figure 3:
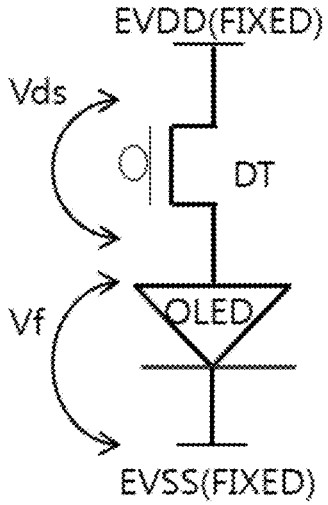
FIGS. 3, 4, and 5 are diagrams for describing a portion in association with a degradation in a light emitting display apparatus.
Figure 4:
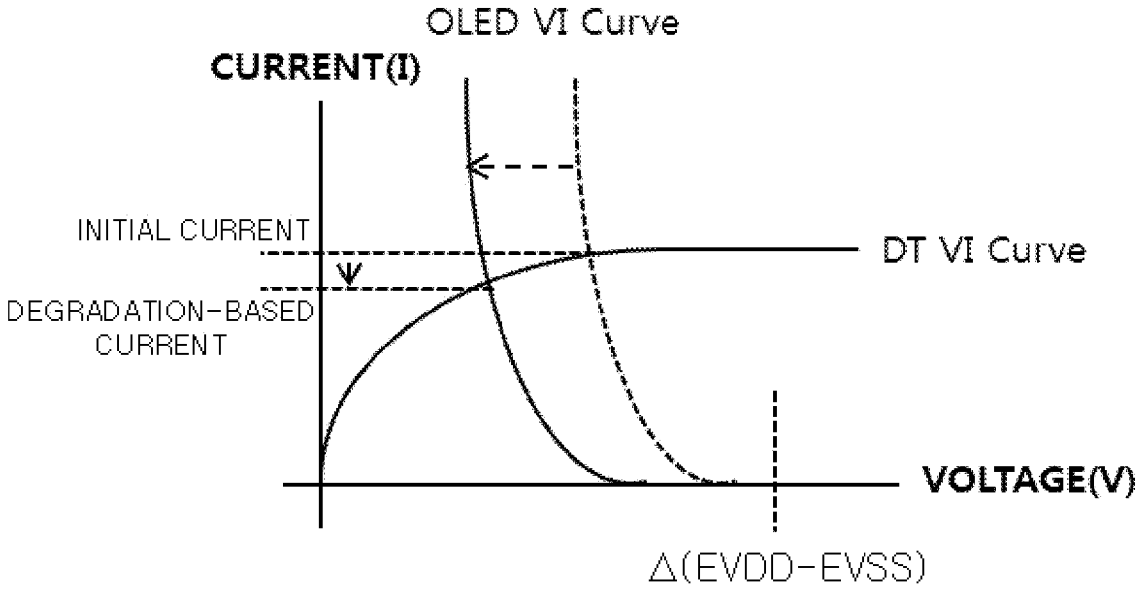
Figure 5:
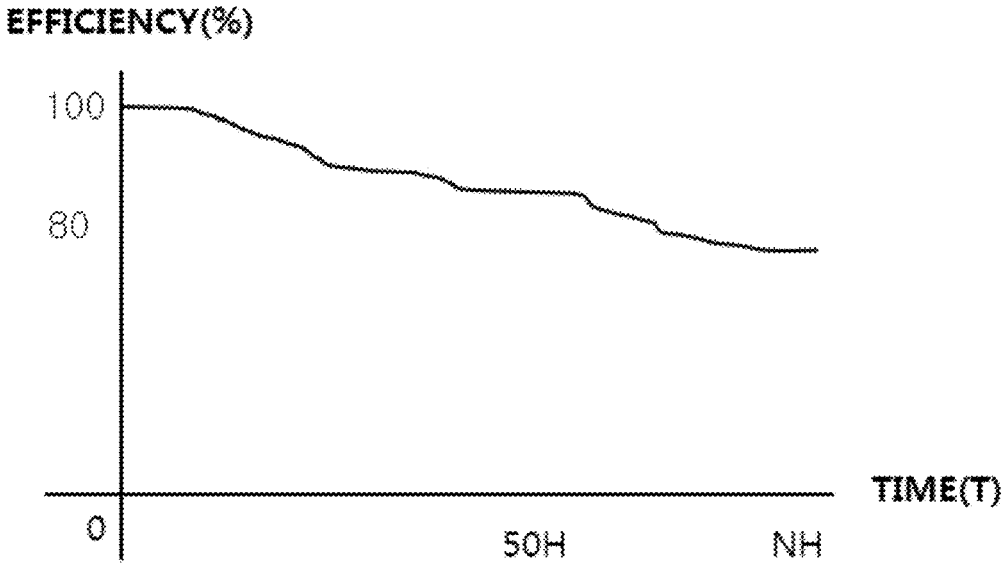

FIGS. 3 to 5 are diagrams for describing a portion association with a degradation in a light emitting display apparatus.

As illustrated in FIGS. 3 to 5, a driving transistor DT and an organic light emitting diode OLED of a subpixel included in a display panel may operate based on a first driving voltage EVDD and a second driving voltage EVSS which are fixed. The organic light emitting diode OLED may be degraded as a driving time elapses.

When the organic light emitting diode OLED is degraded, a forward voltage Vf may increase. Also, the increase in the forward voltage Vf of the organic light emitting diode OLED may decrease a source-drain voltage Vds of the driving transistor DT.

When the organic light emitting diode OLED is degraded, a voltage-current curve (OLED VI Curve) of the organic light emitting diode OLED moves although a voltage-current curve (DT VI Curve) of the driving transistor DT does not vary, and thus, an output current may decrease as seen in a difference between an initial current and a degradation-based current. Also, when an output current of the organic light emitting diode OLED is reduced as the OLED degrades, the emission efficiency of the organic light emitting diode OLED may be reduced over time.

The following compensation device according to an embodiment of the present disclosure may solve the problems described above.

Figure 6:
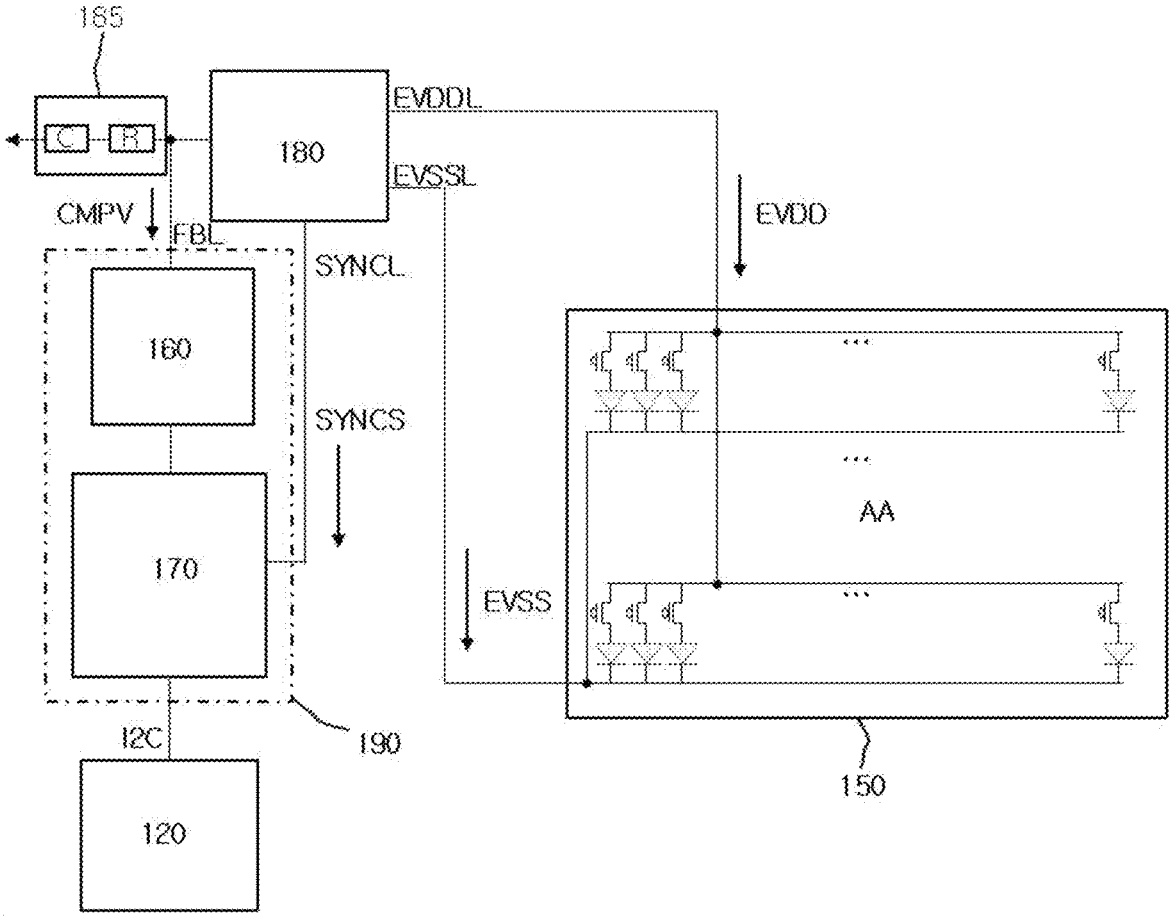
FIG. 6 is a block diagram for describing a light emitting display apparatus according to a first embodiment of the present disclosure.
Figure 7:
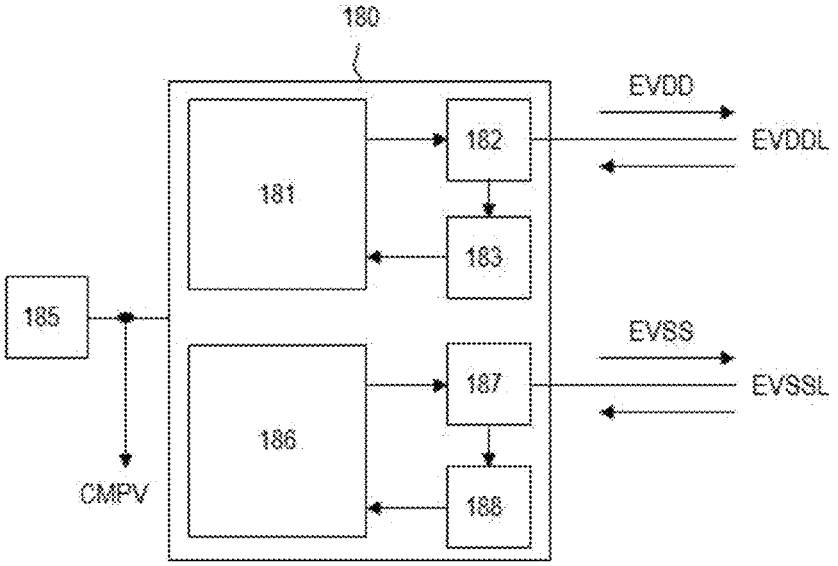
FIG. 7 is a first configuration diagram of a power supply illustrated in FIG. 6.
Figure 8:
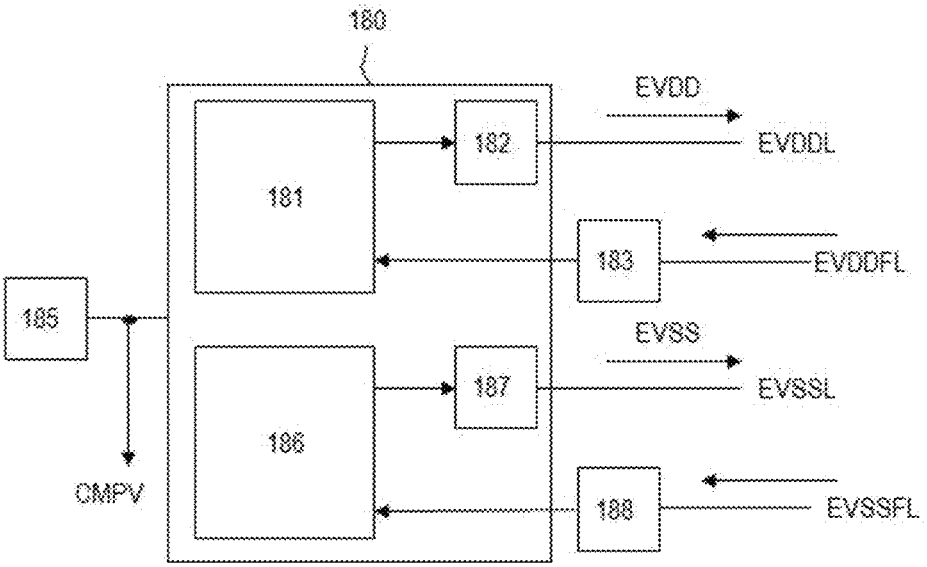
FIG. 8 is a second configuration diagram of the power supply illustrated in FIG. 6.

FIG. 6 is a block diagram for describing a light emitting display apparatus according to a first embodiment of the present disclosure, FIG. 7 is a first configuration diagram of a power supply illustrated in FIG. 6, and FIG. 8 is a second configuration diagram of the power supply illustrated in FIG. 6.

As illustrated in FIGS. 6 to 8, the light emitting display apparatus according to the first embodiment of the present disclosure may include a timing controller 120, a display panel 150, a power supply 180, a passive element unit 185, and a sensing circuit unit 190.

The power supply 180 may supply a first driving voltage EVDD and a second driving voltage EVSS through a first power line EVDDL and a second power line EVSSL each connected to the display panel 150. The power supply 180 may cooperate with the passive element unit 185 which is provided outside, in order to enhance driving stability. The passive element unit 185 may include a plurality of passive elements which include a resistor R and a capacitor C.

The sensing circuit unit 190 may determine whether elements included in the display panel 150 have degraded on the basis of a voltage CMPV flowing through a connection part which aids an electrical connection between the power supply 180 and the passive element unit 185. When the voltage CMPV flowing through the connection part is sensed, a variation of a current based on a degradation in an organic light emitting diode included in the display panel 150 may be sensed. Accordingly, when the degree of reduction of a current is sensed based on the voltage CMPV flowing through the connection part, the degree of degradation of the organic light emitting diode may be checked, and the degradation may be compensated for.

The sensing circuit unit 190 may include a first sensing circuit unit 160 and a second sensing circuit unit 170.

The first sensing circuit unit 160 may be connected to the connection part, which aids an electrical connection between the power supply 180 and the passive element unit 185, through a feedback line FBL. The first sensing circuit unit 160 may sense the voltage CMPV flowing in the connection part through the feedback line FBL and may transfer (feedback) the sensed CMPV to the second sensing circuit unit 170. The first sensing circuit unit 160 may be implemented based on a circuit where an input impedance thereof is large, in order not to adversely affect the feedback line FBL.

The second sensing circuit unit 170 may calculate a sensing value for determining whether the organic light emitting diode included in the display panel 150 has degraded on the basis of the voltage CMPV transferred from the first sensing circuit unit 160. The second sensing circuit unit 170 may determine whether the organic light emitting diode has degraded on the basis of the sensing value, or may transfer the sensing value to the timing controller 120 to aid the timing controller 120 which determines whether the organic light emitting diode has degraded.

The second sensing circuit unit 170 may perform a sensing operation on the basis of an operation characteristic of the power supply 180. To this end, the second sensing circuit unit 170 and the power supply 180 may have an electrical connection therebetween through a signal line SYNCL. The second sensing circuit unit 170 may calculate the sensing value with respect to a certain period, a certain time, and a certain count, on the basis of a control signal SYNCS transferred through the signal line SYNCL.

The timing controller 120 may receive the sensing value, calculated by the sensing circuit unit 190, through a communication interface I2C connected to the second sensing circuit unit 170 and may compensate for degradation in the organic light emitting diode on the basis of the received sensing value. The communication interface I2C connected between the timing controller 120 and the second sensing circuit unit 170 may be implemented with I2C for example, but is not limited thereto.

In above description, each of the power supply 180 and the sensing circuit unit 190 may be implemented as an independent device for example, but the sensing circuit unit 190 may be included in the power supply 180. Hereinafter, a configuration for sensing a voltage of the display panel 150 will be described for example.

As illustrated in FIGS. 7 and 8, the power supply unit 180 may include a plurality of first power circuit units 181 to 183 for outputting and feeding back the first driving voltage and a plurality of second power circuit units 186 to 187 for outputting and feeding back the second driving voltage.

The first power circuit units 181 to 183 may include a first pulse signal generating unit 181, a first driving voltage output unit 182, and a first driving voltage feedback unit 183. The first pulse signal generating unit 181 may generate and output a first pulse width modulation signal for controlling the first driving voltage output unit 182. The first driving voltage output unit 182 may generate and output the first driving voltage EVDD on the basis of the first pulse width modulation signal output from the first pulse signal generating unit 181. The first driving voltage feedback unit 183 may feed back the first driving voltage EVDD, output through a first driving power line EVDDL connected to the display panel, to the first pulse signal generating unit 181 and the passive element unit 185.

The second power circuit units may include a second pulse signal generating unit 186, a second driving voltage output unit 187, and a second driving voltage feedback unit 188. The second pulse signal generating unit 186 may generate and output a second pulse width modulation signal for controlling the second driving voltage output unit 187. The second driving voltage output unit 187 may generate and output the second driving voltage EVSS on the basis of the second pulse width modulation signal output from the second pulse signal generating unit 186. The second driving voltage feedback unit 188 may feed back the second driving voltage EVSS, output through a second driving power line EVSSL connected to the display panel, to the second pulse signal generating unit 186 and the passive element unit 185.

As seen in FIGS. 7 and 8, the first driving voltage feedback unit 183 and the second driving voltage feedback unit 188 for feeding back the first driving voltage EVDD and the second driving voltage EVSS through the first driving power line EVDDL and the second driving power line EVSSL may be disposed in or outside the power supply 180.

In a case where the first driving voltage feedback unit 183 and the second driving voltage feedback unit 188 are disposed outside the power supply 180 as in FIG. 8, a first driving voltage feedback line EVDDFL and a second driving voltage feedback line EVSSFL are provided at specific positions, and voltages may be directly sensed therefrom. However, when the first driving voltage feedback unit 183 and the second driving voltage feedback unit 188 are disposed in the power supply 180 and a voltage is indirectly sensed as in FIG. 7, the complexity of a device may be reduced.

Figure 9:
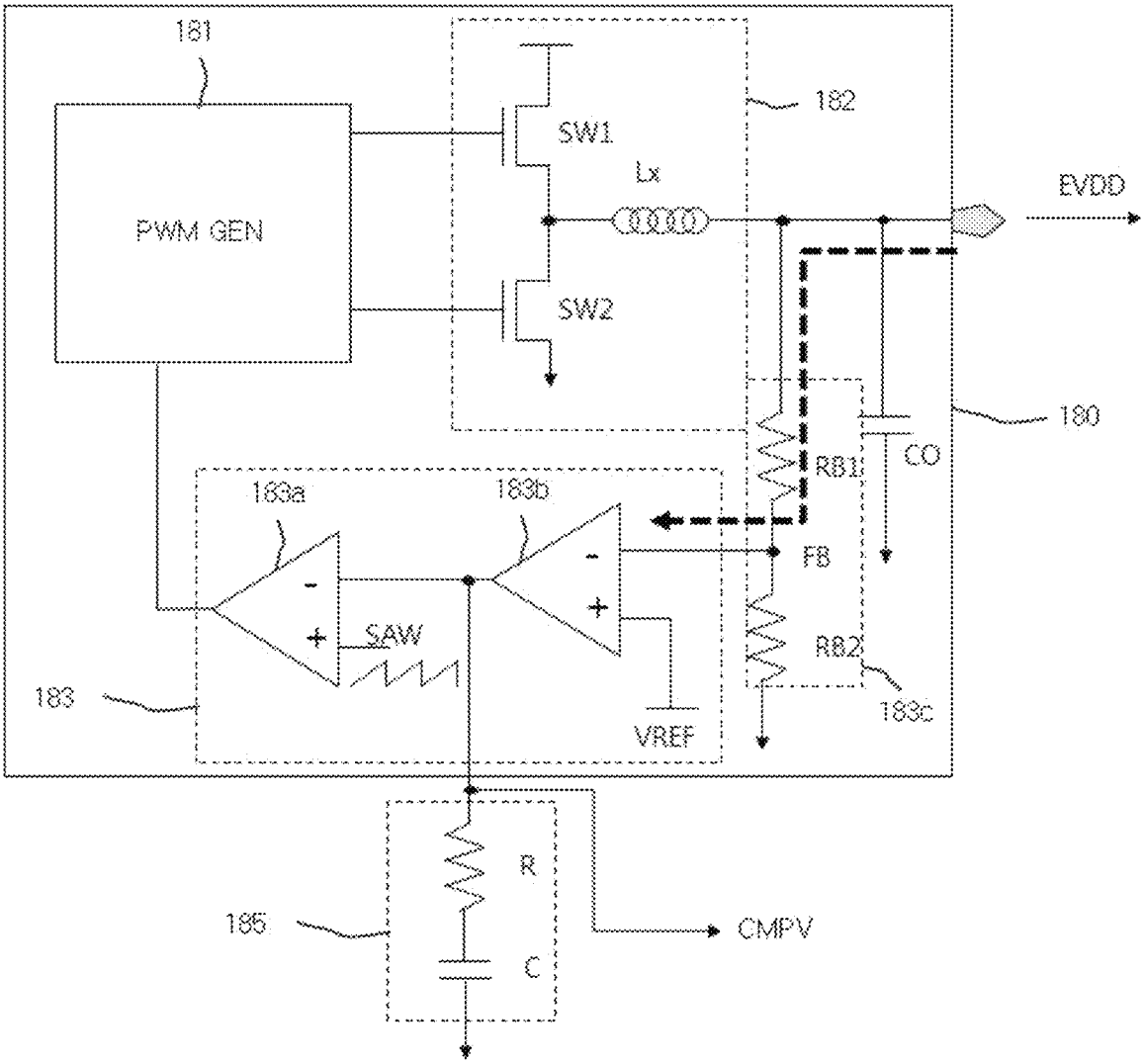
FIGS. 9 and 10 are block diagrams for describing in detail a configuration of each of a power supply and a sensing circuit unit of a light emitting display apparatus according to a second embodiment of the present disclosure.
Figure 10:
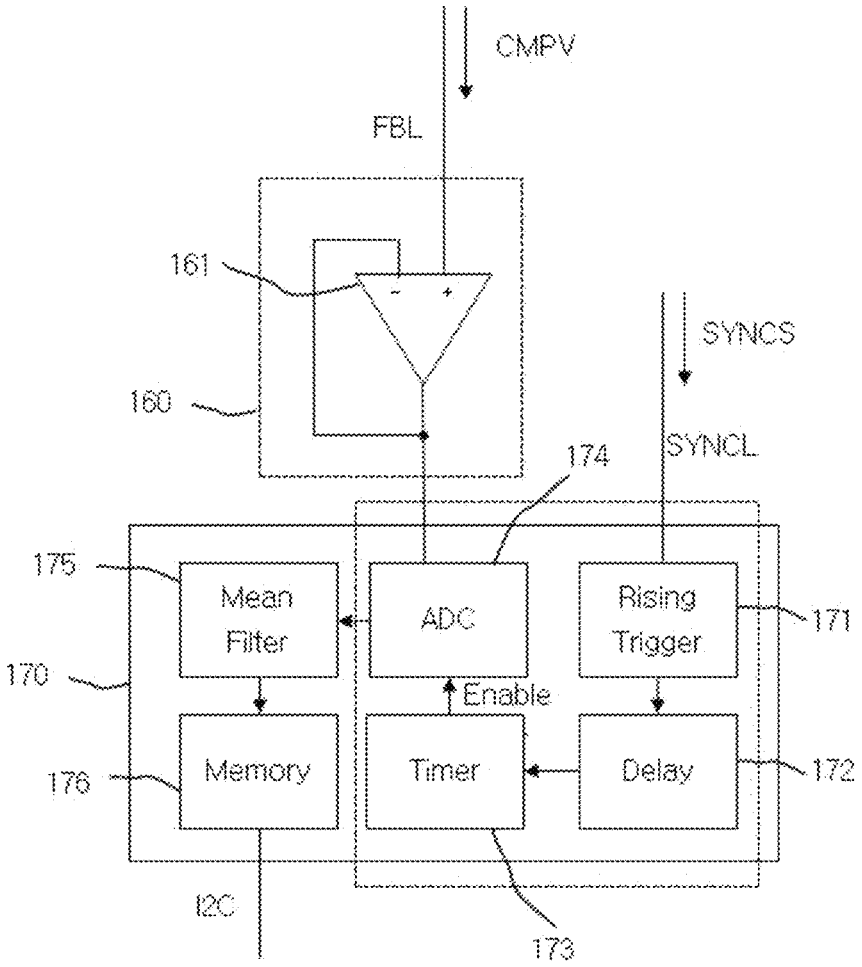

FIGS. 9 and 10 are block diagrams for describing in detail a configuration of each of a power supply and a sensing circuit unit of a light emitting display apparatus according to a second embodiment of the present disclosure.

As illustrated in FIG. 9, first power circuit units of a power supply 180 may include a first pulse signal generating unit 181 (PWM GEN), a first driving voltage output unit 182, and a first driving voltage feedback unit 183.

The first pulse signal generating unit 181 may generate and output a first pulse width modulation signal for controlling the first driving voltage output unit 182. The first pulse signal generating unit 181 may control each of at least two switch elements SW1 and SW2 included in the first driving voltage output unit 182 on the basis of the first pulse width modulation signal.

The first driving voltage output unit 182 may generate and output a first driving voltage EVDD on the basis of the first pulse width modulation signal output from the first pulse signal generating unit 181. The first driving voltage output unit 182 may include the at least two switch elements SW1 and SW2, at least one inductor Lx, and at least one capacitor CO, but is not limited thereto.

The at least two switch elements SW1 and SW2 may have a structure which is serially connected between a high voltage terminal and a low voltage terminal each provided in the power supply 180. The at least two switch elements SW1 and SW2 may be turned on/off based on the first pulse width modulation signal and may output a voltage, and the inductor Lx and the capacitor CO may charge/discharge the voltage output from the at least two switch elements SW1 and SW2 and may output the first driving voltage EVDD.

The first driving voltage feedback unit 183 may feed back a feedback component of the first driving voltage EVDD, output through the first driving voltage line EVDDL connected to the display panel, to the first pulse signal generating unit 181 and the passive element unit 185. The first driving voltage feedback unit 183 may include a first circuit unit 183*a*, a second circuit unit 183*b*, and a third circuit unit 183*c*.

The first circuit unit 183*a* may output a voltage needed for an operation of the first pulse signal generating unit 181 on the basis of an output voltage output from the second circuit unit 183*b* and a synchronization signal SAW output from a controller which is provided in the power supply 180. The synchronization signal SAW may be transferred to the sensing circuit unit 190 through a signal line SYNCL. That is, the synchronization signal SAW of the first circuit unit 183*a* may be used as a synchronization signal of the sensing circuit unit 190.

The first pulse signal generating unit 181 may vary a driving condition such as a frequency or a period of the first pulse width modulation signal on the basis of a voltage output from the first driving voltage feedback unit 183. To this end, the first circuit unit 183*a* may include an inverting terminal (−) connected to an output terminal of the second circuit unit 183*b*, a noninverting terminal (+) connected to the controller provided in the power supply 180, and an output terminal connected to the first pulse signal generating unit 181.

The second circuit unit 183*b* may output a feedback voltage needed for an operation of the first circuit unit 183*a* on the basis of a feedback first driving voltage transferred from the third circuit unit 183*c* and a reference voltage output from a reference voltage generating unit which is provided in the power supply 180.

The second circuit unit 183*b* may compare the feedback first driving voltage with the reference voltage and may output a low-voltage or high-voltage feedback voltage on the basis of a comparison result. To this end, an inverting terminal (−) of the second circuit unit 183*b* may be connected to a voltage division node FB of the third circuit unit 183*c*, a noninverting terminal (+) of the second circuit unit 183*b* may be connected to a reference voltage terminal VREF, and an output terminal of the second circuit unit 183*b* may be connected to the inverting terminal (−) of the first circuit unit 183*a*. A feedback voltage output through the output terminal of the second circuit unit 183*b* may be affected by a resistor R and a capacitor C each included in the passive element unit 185. That is, the feedback voltage output through the output terminal of the second circuit unit 183*b* may have an output waveform which is changed by a time constant based on the resistor R and the capacitor C each included in the passive element unit 185.

The third circuit unit 183*c* may feed back the first driving voltage, output through an output terminal of the power supply 180, to the inside of the first driving voltage feedback unit 183. The third circuit unit 183*c* may include a first resistor RB1 and a second resistor RB2. One end of the first resistor RB1 may be connected to the output terminal of the power supply 180, the other end of the second resistor RB2 may be connected to a low voltage terminal provided in the power supply 180, and the other end of the first resistor RB1 and one end of the second resistor RB2 may be connected to the voltage division node FB in common.

As illustrated in FIG. 10, the first sensing circuit unit 160 may transfer a feedback voltage CMPV, which is a feedback component of the first driving voltage transferred through a feedback line FBL, to the second sensing circuit unit 170. The first sensing circuit unit 160 may be implemented based on an amplifier 160 where an input impedance thereof is large, in order not to affect the feedback line FBL.

The amplifier 160 may be implemented with a voltage follower which enables an input voltage to be transferred as an output voltage as-is. To this end, the amplifier 160 may include a noninverting terminal (+) connected to the feedback line FBL and an inverting terminal (−) connected to an input terminal of an ADC 174 included in the second sensing circuit unit 170.

The second sensing circuit unit 170 may calculate a sensing value for determining the occurrence or not of a degradation in the organic light emitting diode included in the display panel 150 on the basis of the feedback voltage CMPV transferred from the first sensing circuit unit 160. The second sensing circuit unit 170 may include a rising trigger (or signal detector) 171, a delay (or delay circuit) 172, a timer 173, an analog-to-digital converter (ADC) 174, a mean filter 175, and a memory 176.

The rising trigger 171 may detect a rising edge period (detect a rising time of a control signal) in a control signal SYNCS transferred through a signal line SYNCL and may trigger the start of an operation of the delay 172.

The delay 172 may delay a certain time from a rising time of the control signal SYNCS transferred through the signal line SYNCL. The delay 172 may operate the timer 173 on the basis of triggering by the rising trigger 171.

The timer 173 may determine whether to perform a sensing operation for a certain time, on the basis of a signal transferred from the delay 172. To this end, the timer 173 may output an enable signal for enabling an operation of the ADC 174 and a disable signal for disabling the operation of the ADC 174. That is, a sensing time of the ADC 174 may be determined by the timer 173.

The ADC 174 may perform an operation of converting (sensing) the feedback voltage CMPV transferred from the first sensing circuit unit 160 on the basis of the enable signal output from the timer 173. Based on the enable signal, the ADC 174 may receive an analog feedback voltage CMPV N (where N is an integer of 1 or more) times and may convert the analog feedback voltage CMPV into a digital sensing value to output the digital sensing value.

The mean filter 175 may average N number of sensing values output from the ADC 174 to output an averaged sensing value. To this end, the mean filter 175 may be implemented as a mean filter, but is not limited thereto.

The memory 176 may store a sensing value output from the mean filter 175. The memory 176 may include a storage space which sequentially store the sensing value output from the mean filter 175 on the basis of time, date, or year. The memory 176 may also store an initial sensing value. The sensing value stored in the memory 176 may be transferred to the timing controller 120 through the communication interface I2C.

When an averaged sensing value is greater than a reference value defined in the timing controller 120, the timing controller 120 may perform a compensation operation of compensating for an organic light emitting diode, and when the averaged sensing value is less than the reference value, the timing controller 120 may not compensate for the organic light emitting diode.

Except for the rising trigger 171, the delay 172, the timer 173, and the ADC 174, the mean filter 175 and the memory 176 may be included in the timing controller 120. Also, the rising trigger 171, the delay 172, the timer 173, and the ADC 174 may be included in the power supply.

Figure 11:
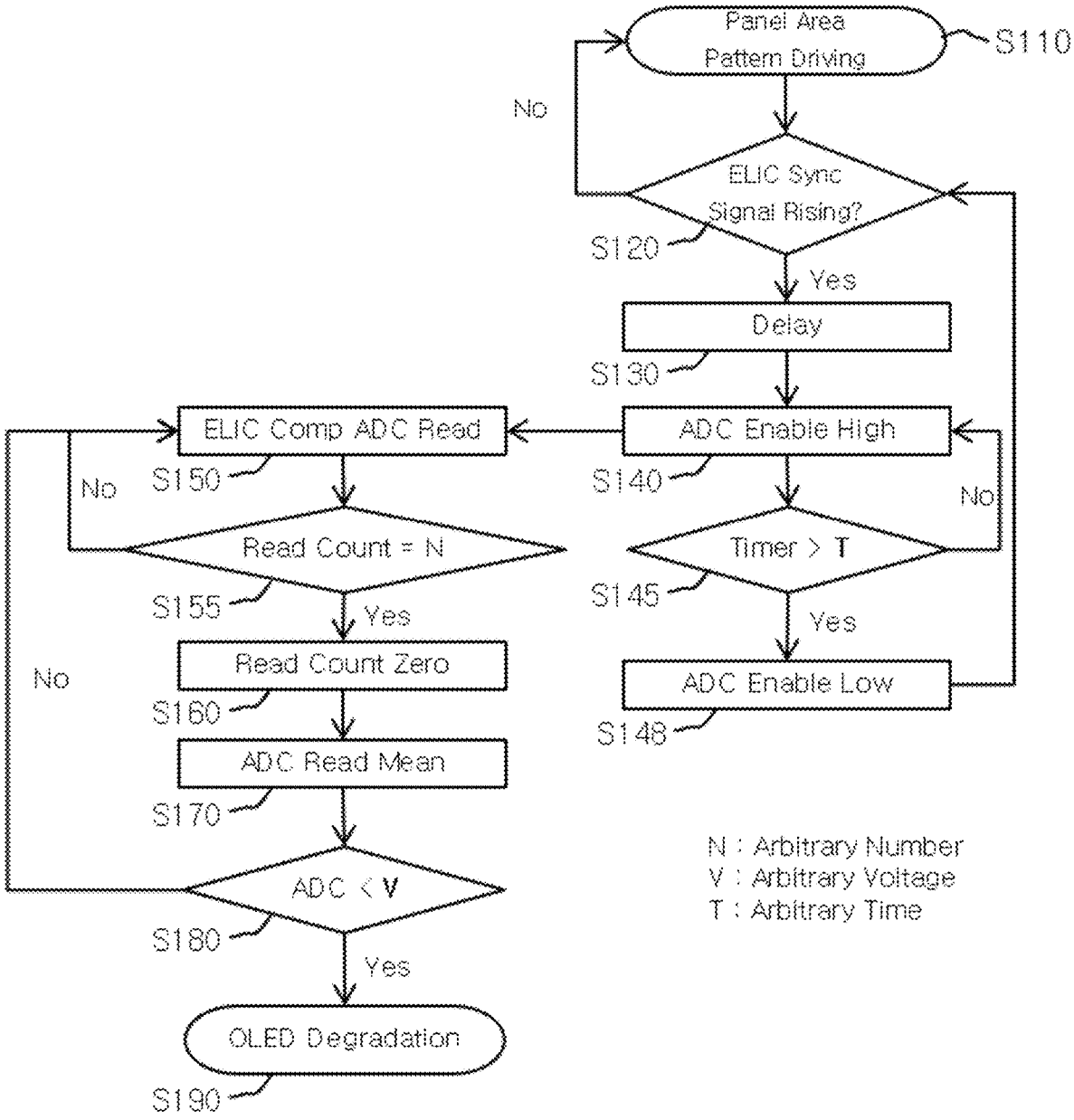
FIG. 11 is a flowchart for describing a sensing method of a light emitting display apparatus according to a third embodiment of the present disclosure.
Figure 12:
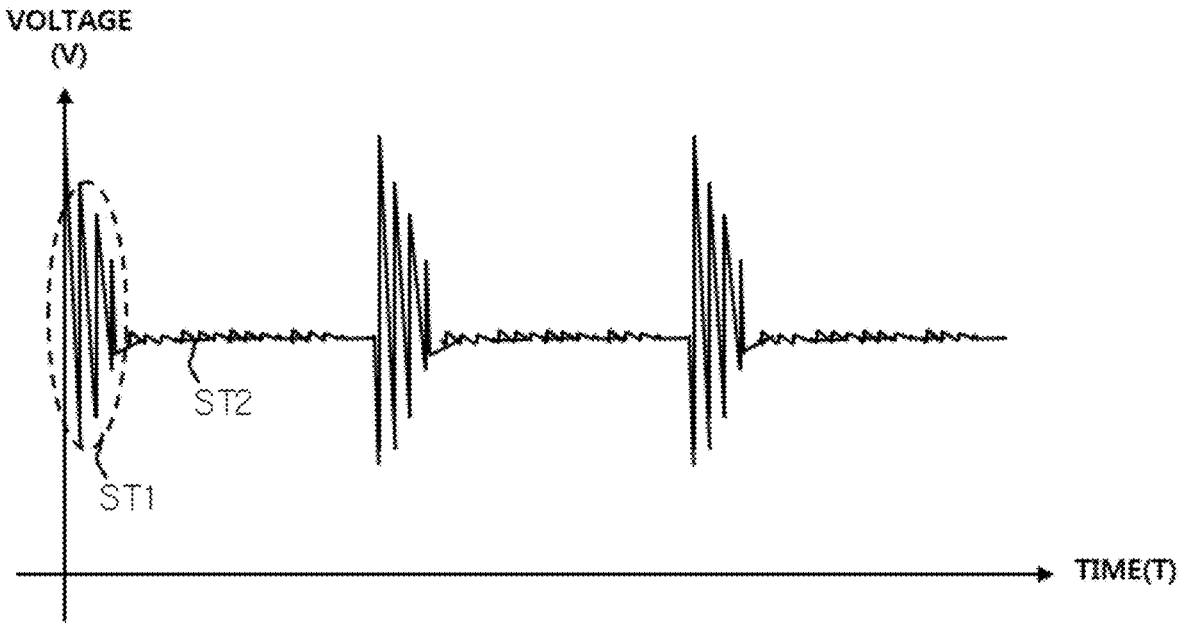
FIGS. 12, 13 and 14 are waveform diagrams for describing the sensing method of the light emitting display apparatus according to the third embodiment of the present disclosure.
Figure 13:
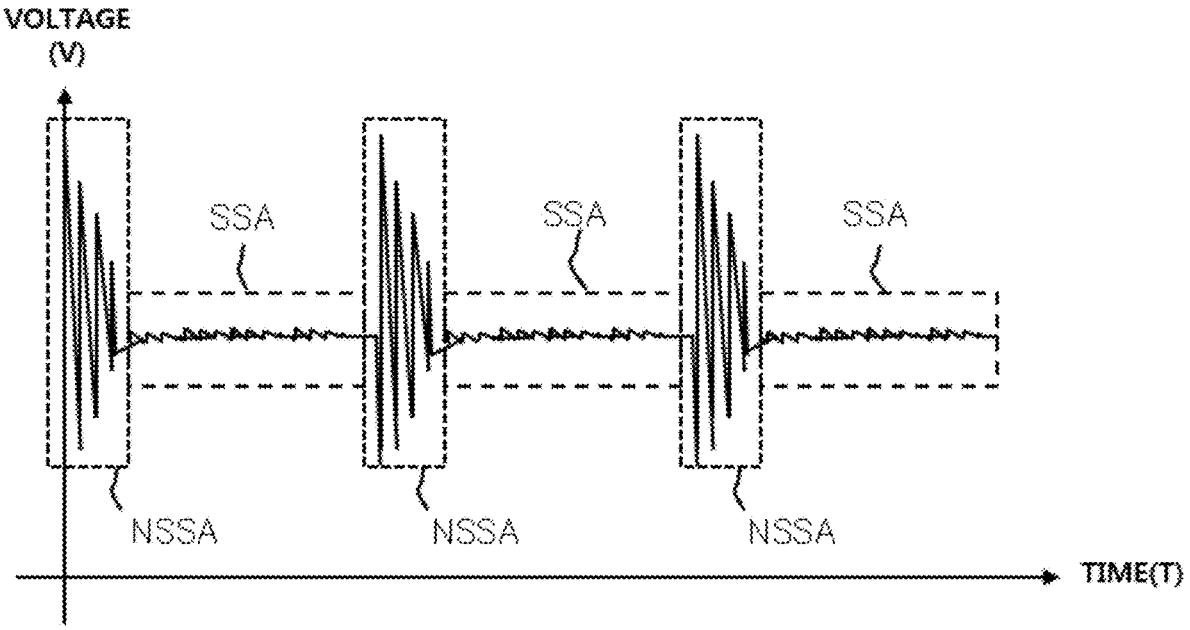
Figure 14:
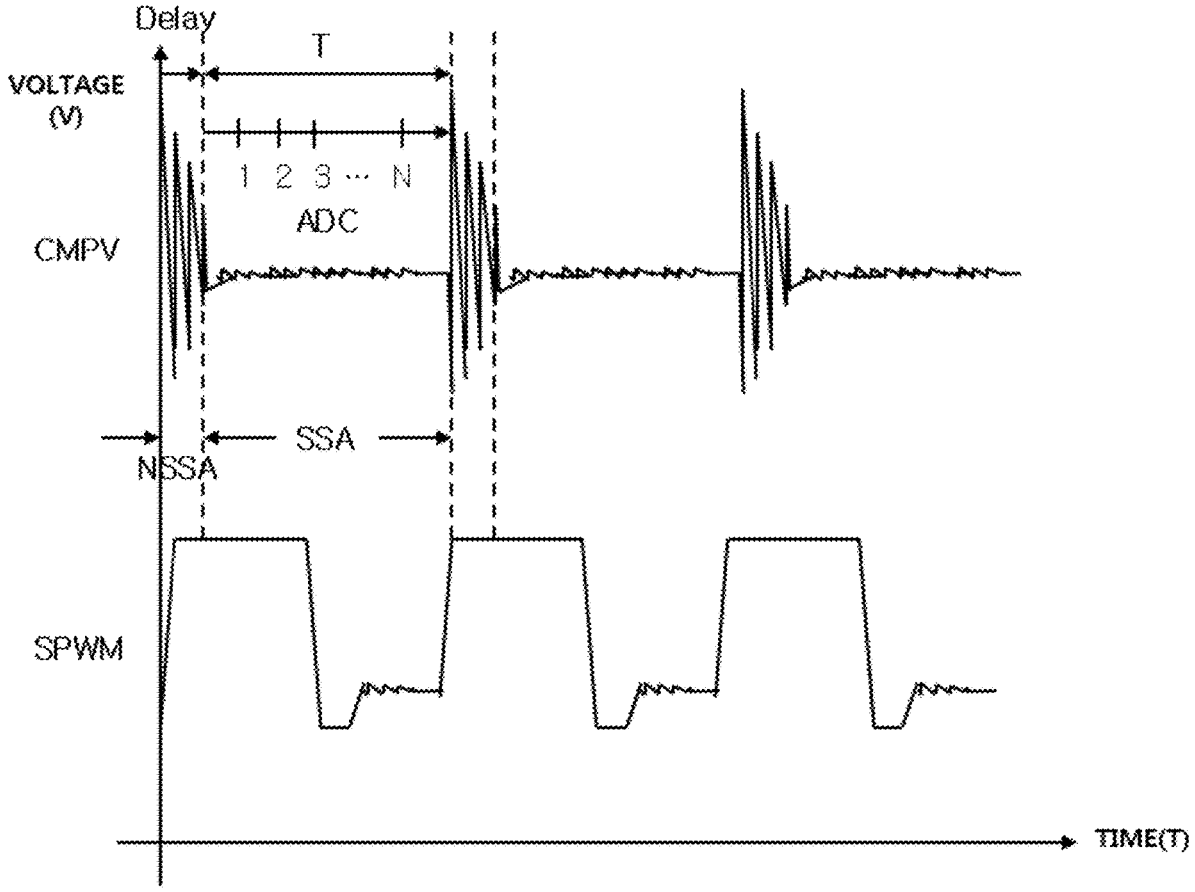

FIG. 11 is a flowchart for describing a sensing method of a light emitting display apparatus according to a third embodiment of the present disclosure, and FIGS. 12 to 14 are waveform diagrams for describing the sensing method of the light emitting display apparatus according to the third embodiment of the present disclosure. Hereinafter, in order to help understanding, the sensing method of the light emitting display apparatus according to the third embodiment of the present disclosure will be described with reference to FIGS. 9 and 10.

As illustrated in FIG. 11, the sensing method of the light emitting display apparatus according to the third embodiment of the present disclosure may include an operation (S110) of displaying a pattern in a display panel area, an operation (S190) of determining whether an organic light emitting diode (OLED) has degraded, and other operations and may be performed in the following order.

In the operation (S110) of displaying the pattern in the display panel area, a special (specific) pattern easy to determine a degradation in the display panel 150 may be used, but is not limited thereto.

When the pattern is displayed in the display pattern area, an operation (S120) of determining whether the control signal SYNCS transferred to the sensing circuit unit 190 has risen may be performed for synchronization between the power supply 180 and the sensing circuit unit 190.

When the power supply 180 is synchronized with the sensing circuit unit 190 (Yes), after a certain time elapses, a delay operation (S130) may be performed to perform a sensing operation of sensing the feedback voltage CMPV through the connection part. However, when the power supply 180 is not synchronized with the sensing circuit unit 190 (No), the operation (S110) of displaying a pattern in a display panel area may be performed again.

Subsequently, a logic high enable signal (ADC Enable High) for enabling an operation of the ADC 174 may be output to perform a feedback voltage CMPV sensing operation of the ADC 174 (S140), and an operation (S145) of comparing an input time T with a setting time set in the timer 173 may be performed for setting a sensing period.

When the setting time (timer) is greater than the input time T (Yes), an operation (S148) of outputting a logic low enable signal (ADC Enable Low) for stopping the operation of the ADC 174 may be performed. After the operation (S148) of outputting the logic low enable signal (ADC Enable Low), the sensing method may return to the operation (S120) of determining the rising or not (ELIC Sync Signal Rising) of the control signal SYNCS transferred to the sensing circuit unit 190, for next-order sensing.

The reason that the driving method includes operations including the delay operation (S130) and the operation (S148) of outputting an enable signal associated with an operation of the ADC 174 after the power supply 180 is synchronized with the sensing circuit unit 190 will be described below.

As illustrated in FIGS. 11 to 14, the feedback voltage CMPV transferred through the feedback line FBL of the sensing circuit unit 190 may include a first period ST1 and a second period ST2. The first period ST1 may be a period which has a noise component such as overshoot on the basis of an internal switching operation of the power supply 180, and the second period ST2 may be a period which is stabilized as a noise component such as overshoot is removed. A noise phenomenon such as the first period ST1 may correspond to a rising edge period of the pulse width modulation signal SPWM for driving an internal switch of the power supply 180.

The delay operation (S130) may be performed for defining the first period ST1, which is electrically unstable due to overshoot, as a non-sensing area NSSA and defining the second period ST2, which is electrically stabilized, as a sensing area SSA. When a signal delay operation of removing the unstable first period ST1 in the sensing area SSA is performed, only a stabilized component may be selectively obtained, and thus, the accuracy of sensing may be enhanced.

The operation (S145) of comparing the input time T with the setting time set in the timer 173 may be performed for setting a sensing period, and the operation (S140) of outputting the logic high enable signal and the operation (S148) of outputting the logic low enable signal may be used for controlling an operation of the ADC 174.

When the logic high enable signal (ADC Enable High) is output, the ADC 174 may perform (ELIC Comp ADC Rea) an operation (S150) of reading the feedback voltage CMPV transferred through the feedback line FBL so as to perform a sensing operation.

When the logic high enable signal (ADC Enable High) is output, the ADC 174 may perform (Read Count=N) an operation (S155) of setting a sensing count along with the sensing operation. The ADC 174 may receive an analog feedback voltage CMPV N (where N is an integer of 1 or more) times and may convert the analog feedback voltage CMPV into a digital sensing value to output the digital sensing value. Whether a count value (Count) satisfies N may be checked for N-times sensing by the ADC 174. When the count value does not satisfy N (No), the sensing method may return to the operation (S150) of reading the feedback voltage CMPV.

However, when the count value satisfies N (Yes), a sensing operation by the ADC 174 may be completed, and an operation (S160) of initializing (Read Count Zero) the count value (Count) into 0 may be performed. Based on such an operation, the sensing operation by the ADC 174 may stop.

When the sensing operation by the ADC 174 stops, an operation (S170) of averaging (ADC Read Mean) sensing values calculated N times may be performed. An operation (S180) of comparing (ADC<V) an averaged sensing value with the reference value defined therein to determine whether an averaged sensing value is greater or less than the reference value may be performed. When the averaged sensing value is greater than the reference value (Yes), a degradation in the organic light emitting diode (OLED degradation) may be determined (S190). However, when the averaged sensing value is greater than the reference value (No), the organic light emitting diode may not be degraded, and thus, a next sensing operation may be performed.

Figure 17:
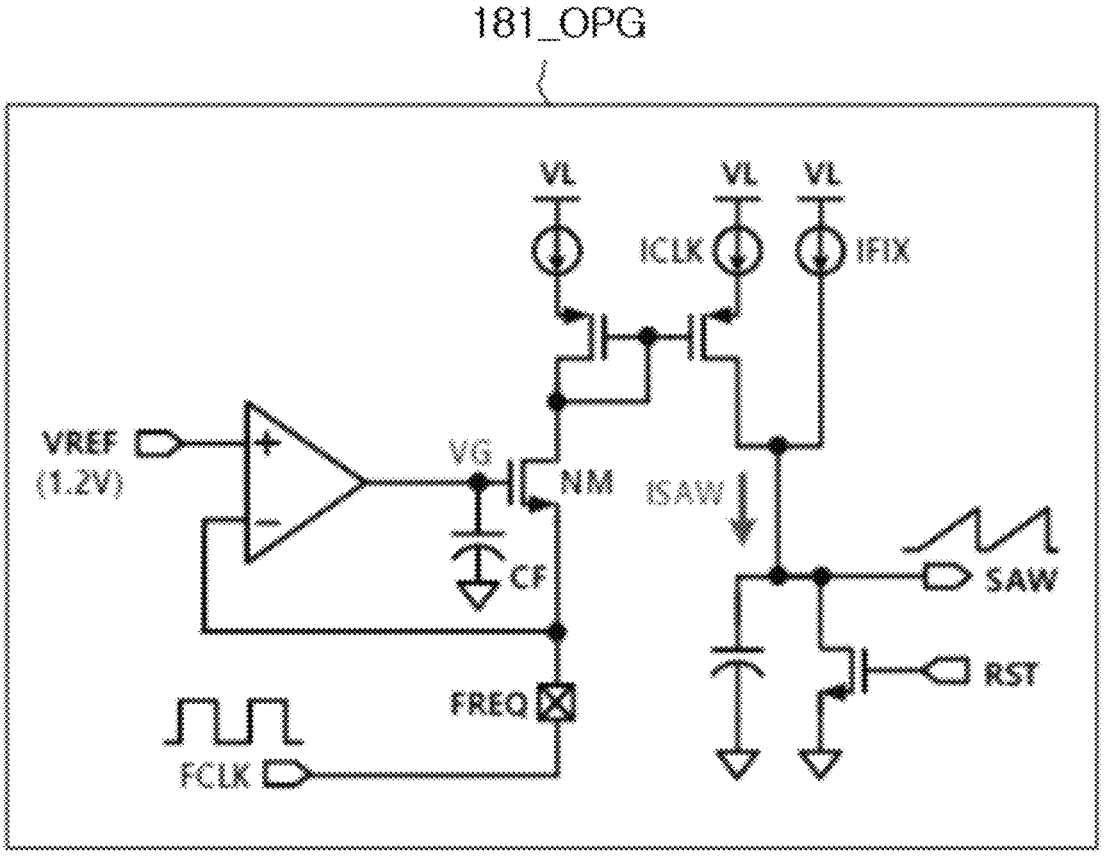
Figure 18:
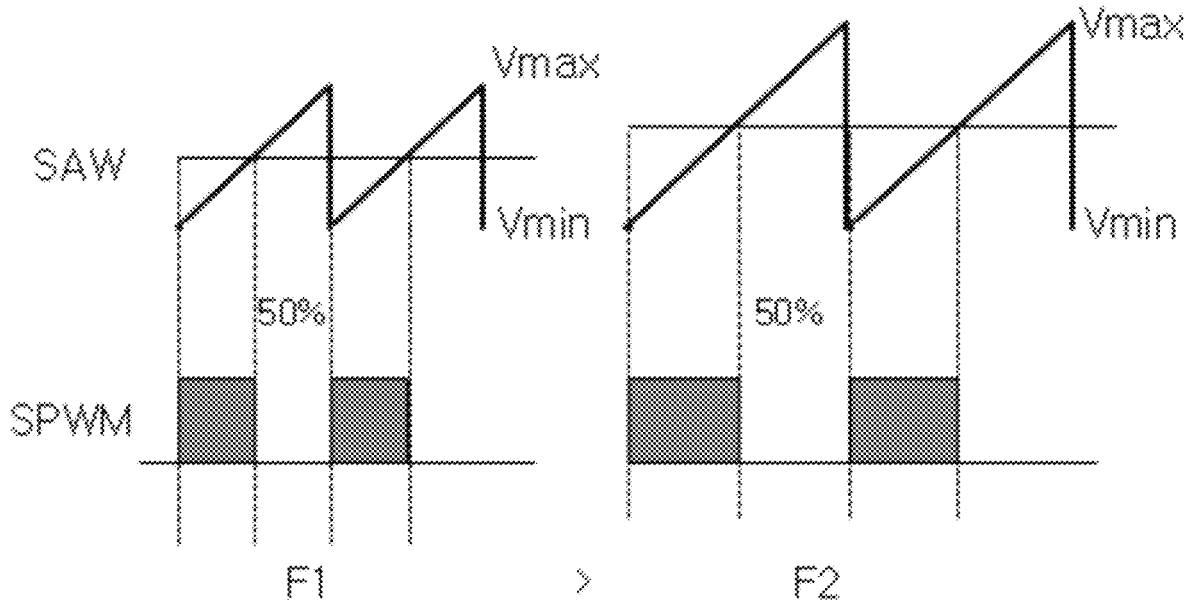
Figure 19:
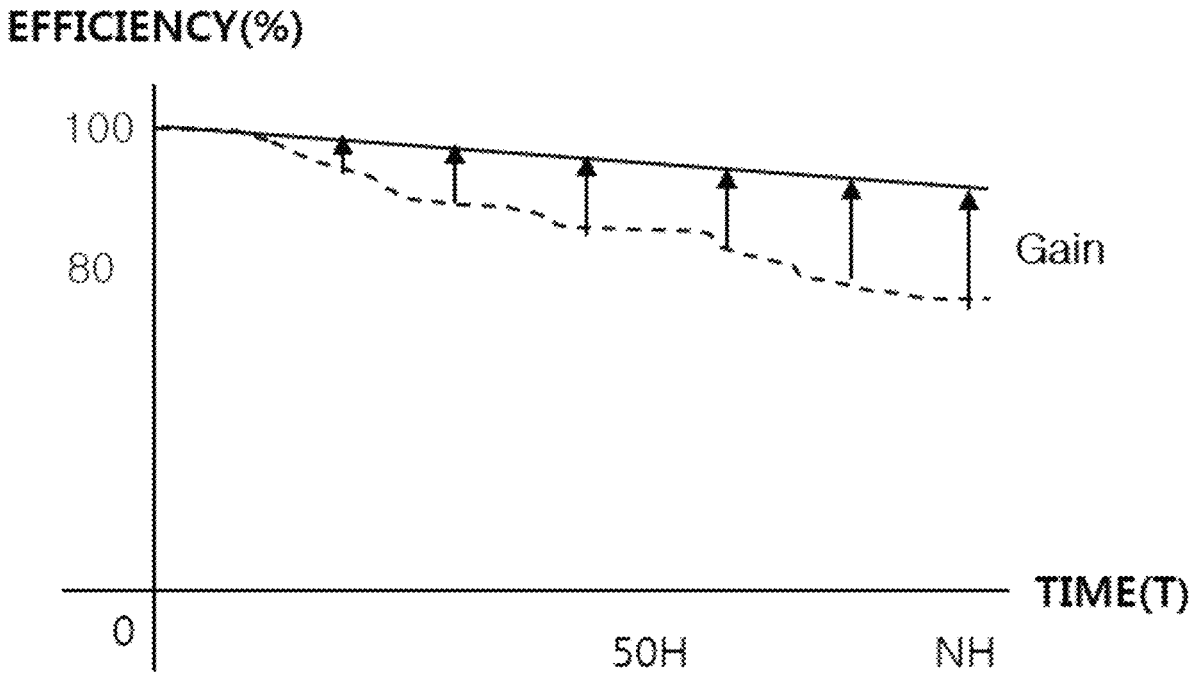
FIG. 19 is a diagram for describing a compensation method using a light emitting display apparatus according to embodiments of the present disclosure.

FIGS. 15 to 18 are diagrams for describing a portion associated with a sensing principle and a driving mode according to embodiments of the present disclosure, and FIG. 19 is a diagram for describing a compensation method using a light emitting display apparatus according to embodiments of the present disclosure.

Figure 15:
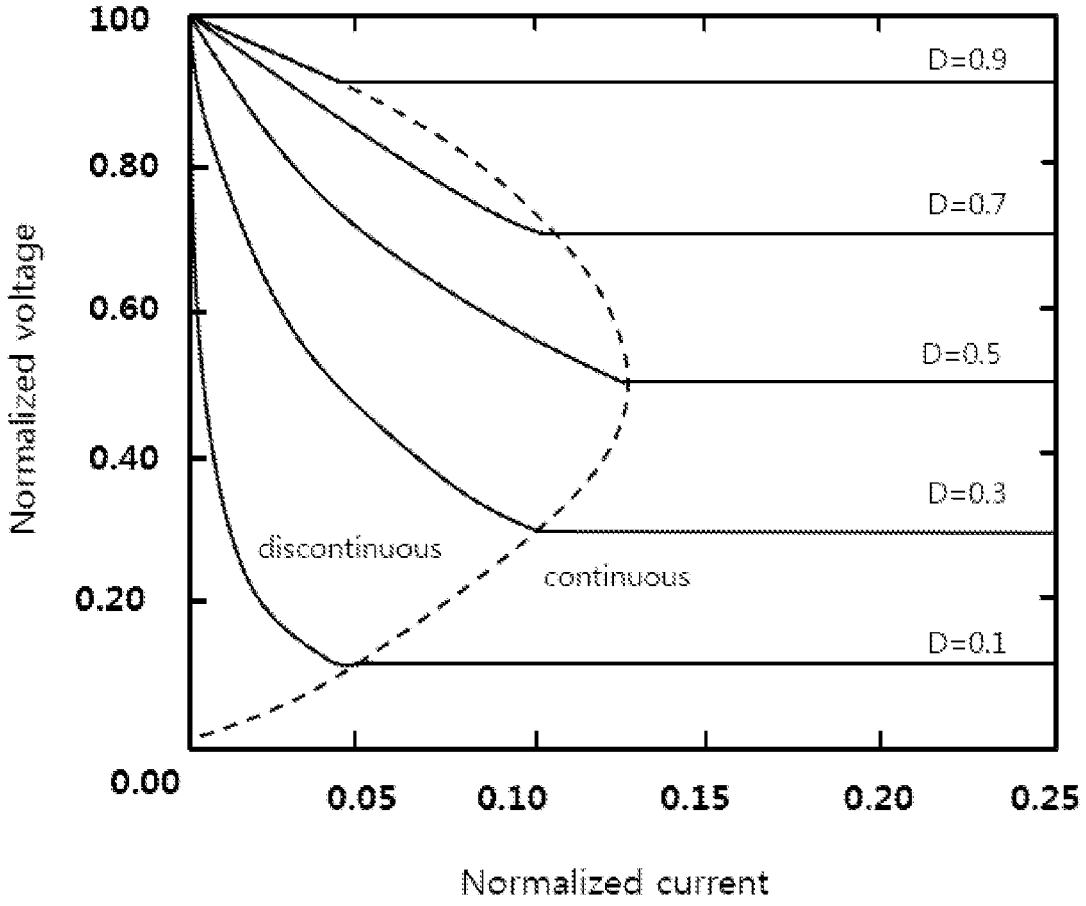
FIGS. 15, 16, 17, and 18 are diagrams for describing a portion associated with a sensing principle and a driving mode according to embodiments of the present disclosure.
Figure 16:
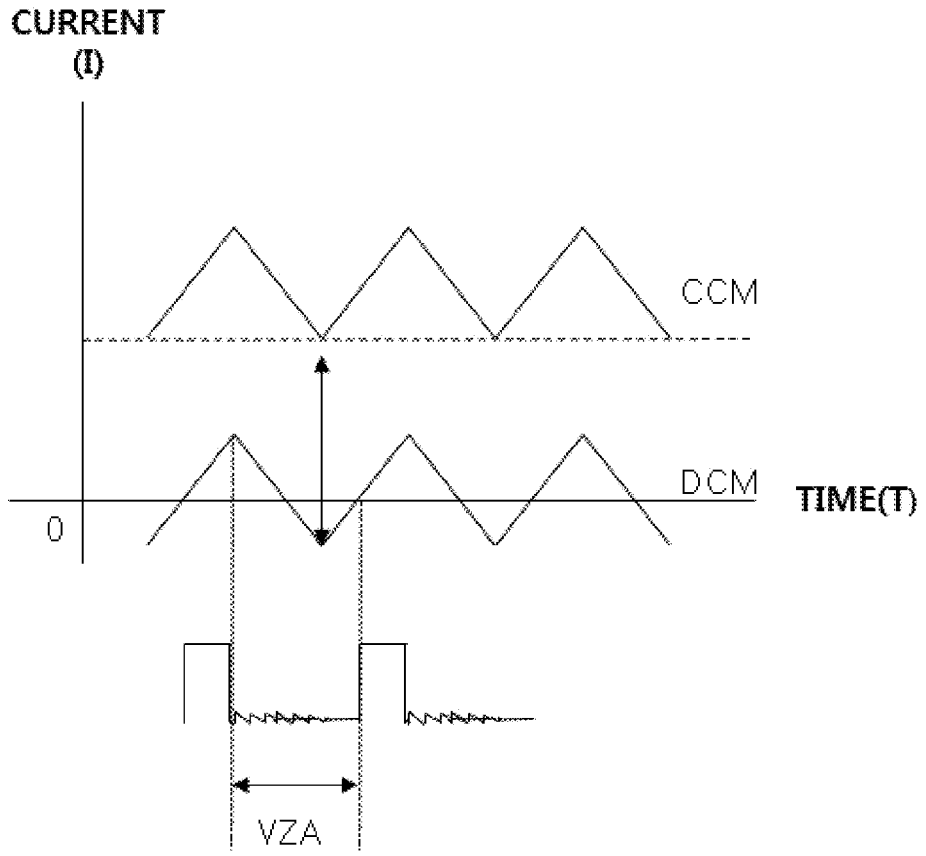

As illustrated in FIGS. 15 and 16, in a power supply according to embodiments of the present disclosure, when an output voltage is fixed, a duty may vary based on a load. However, an output voltage may be generated based on a duty, and thus, it may be seen that a variation of a duty is irrelevant to the output current. However, when a duty is fixed, it may be seen that the output voltage increases as the output current decreases.

The present disclosure may be based on a concept where, as the output current decreases in a discontinuous conduction mode DCM of the power supply, a switching duty is reduced and a phenomenon where a duty decreases is capable of being determined by sensing an output voltage of a circuit. In a case where the concept is applied to the present disclosure, when the output current is lowered, a duty may be lowered, and when a duty is lowered, a sensed voltage may be lowered. The output current being lowered may be used as an indicator indicating that the organic light emitting diode is degraded.

To this end, the power supply may set a lowest value of a switching frequency so that a duty variation is easily determined, release a forced continuous conduction mode (FCCM), and set an output voltage of a circuit to the lowest value. In this case, a slope of sawtooth used as a control signal may increase, and thus, the output voltage of the circuit may increase. Sawtooth used as the control signal may be one of control signals used to control a pulse signal generating unit such as a buck converter control logic included in the power supply.

The FCCM may be a mode where a continuous conduction mode (CCM) is forcibly performed for forcibly operating an internal switch of the power supply. A discontinuous conduction mode (DCM) may have a period VZA where a variation is large due to the ripple of an output end of the power supply caused by resonance unlike the CCM. Accordingly, as an output current decreases, a switching duty may be reduced, and the power supply may easily operate in the DCM where a reduction in a duty is determined by sensing the output voltage of the circuit.

When the setting is completed, the display panel may be initially driven, an initial output voltage of a circuit may be stored in a memory subsequently, and the display panel may be driven for a long time subsequently. Such a process may be repeated once or twice, and reference data (a reference value) for determining a degree of degradation may be provided based on a degree of reduction of a voltage of the circuit with respect to an initial sensing value.

As illustrated in FIGS. 17 and 18, a controller 181_OPG of the power supply may include a plurality of control circuits which operate based on a reference voltage terminal VREF, a clock signal terminal FCLK, and an internal voltage terminal VL. Also, a synchronization signal SAW provided based on the control circuits may be applied to a first circuit unit.

When a current ISAW for providing the synchronization signal SAW in the controller 181_OPG of the power supply is constant, a slope of the synchronization signal SAW may be generated to be constant although a frequency of a clock signal applied through the clock signal terminal FCLK varies.

As seen through a comparison result between F1 and F2 of FIG. 18, when a frequency is lowered, a voltage range Vmin and Vmax of the synchronization signal SAW may increase, and thus, a voltage recognizable in a circuit may increase. Therefore, when the same duty is generated, as a frequency is lowered, a voltage recognizable in a circuit may increase, and thus, a sensing resolution of an ADC may also be enhanced. Accordingly, in order to enhance the sensing resolution of the ADC, an internal driving frequency of the power supply may be set to be low, on the basis of a condition described above.

As illustrated in FIG. 19, according to embodiments of the present disclosure, a light emitting display apparatus may determine whether an organic light emitting diode has degraded, and then, an internal gain value of the timing controller may vary for compensating for data. However, this is merely an example, and a gain value and an output voltage of the power supply may vary simultaneously.

The present disclosure may realize an effect of providing a compensation device which senses a degradation in an organic light emitting diode included in a display panel and compensates for the degradation. Also, according to the present disclosure, in a case which senses a degradation in the organic light emitting diode included in the display panel, only an electrically stabilized voltage component may be selected and sensed, and thus, the accuracy of sensing may be enhanced. Also, according to the present disclosure, sensing and compensation may be performed based on cooperation between circuits provided in and outside a power supply and circuits provided in a timing controller, and thus, a configuration of the compensation device may be simplified.

The effects according to the present disclosure are not limited to the above examples, and other various effects may be included in the specification.

While the present disclosure has been particularly shown and described with reference to exemplary embodiments thereof, it will be understood by those of ordinary skill in the art that various changes in form and details may be made therein without departing from the spirit and scope of the present disclosure as defined by the following claims.

What is claimed is:

1. A light emitting display apparatus comprising:

a display panel displaying an image;

a power supply supplying a driving voltage to the display panel;

a data driver supplying a data voltage to the display panel;

a timing controller controlling the power supply and the data driver; and a sensing circuit unit receiving a feedback component of the driving voltage as a feedback voltage and selectively sensing an electrically stabilized period in the feedback voltage based on an internal control signal of the power supply.

2. The light emitting display apparatus of claim 1, wherein the sensing circuit unit detects a rising time of the internal control signal so as to exclude an electrically unstable period from a sensing period and senses the feedback voltage after a certain delay time elapses from the rising time of the internal control signal.

3. The light emitting display apparatus of claim 1, wherein the sensing circuit senses the feedback voltage with respect to a certain period, a certain time, and a certain count, on the basis of the internal control signal.

4. The light emitting display apparatus of claim 1, wherein, based on a voltage follower where an input impedance thereof is large, the sensing circuit unit senses an analog feedback voltage N (where N is an integer of 1 or more) times, converts the analog feedback voltage into a digital sensing value, averages N number of sensing values to calculate an averaged sensing value, and provides the averaged sensing value to the timing controller.

5. The light emitting display apparatus of claim 4, wherein, when the averaged sensing value is greater than a reference value, the timing controller performs a compensation operation of compensating for an organic light emitting diode included in the display panel, and when the averaged sensing value is less than the reference value defined therein, the timing controller does not compensate for the organic light emitting diode.

6. The light emitting display apparatus of claim 1, wherein the sensing circuit unit receives, as the feedback voltage, the feedback component of the driving voltage through a connection part provided between the power supply and a passive element unit cooperating with the power supply.

7. The light emitting display apparatus of claim 1, wherein the sensing circuit unit comprises a first sensing circuit unit including a voltage follower for receiving the feedback component of the driving voltage as the feedback voltage.

8. The light emitting display apparatus of claim 7, wherein the sensing circuit unit comprises:

a rising trigger detecting a rising time of the internal control signal;

a delay delaying a certain time from the rising time of the internal control signal;

a timer outputting an enable signal or a disable signal on the basis of a signal transferred from the delay; and a second sensing circuit unit including an analog-to-digital converter (ADC) sensing the feedback voltage transferred from the first sensing circuit unit on the basis of the enable signal or the disable signal output from the timer.

9. The light emitting display apparatus of claim 8, wherein the second sensing circuit unit comprises:

a mean filter averaging a plurality of sensing values output through the ADC to calculate an averaged sensing value; and a memory storing the averaged sensing value output from the mean filter.

10. A driving method of a light emitting display apparatus, the driving method comprising:

driving a power supply to output a driving voltage for driving a display panel;

receiving a feedback component of the driving voltage as a feedback voltage and detecting a rising time of a control signal of the power supply; and sensing the feedback voltage after a certain delay time elapses from a rising time of the control signal, for selectively sensing an electrically stabilized period in the feedback voltage.

11. The driving method of claim 10, wherein the sensing comprises sensing the feedback voltage with respect to a certain period, a certain time, and a certain count, on the basis of the control signal.

12. The driving method of claim 10, further comprising:

converting the analog feedback voltage into a digital sensing value and averaging a plurality of sensing values to calculate an averaged sensing value;

when the averaged sensing value is greater than a reference value defined therein, performing a compensation operation of compensating for an organic light emitting diode included in the display panel; and when the averaged sensing value is less than the reference value defined therein, stopping compensation performed on the organic light emitting diode.

* * * * *